US007279829B2

(12) United States Patent
Kim et al.

(10) Patent No.: US 7,279,829 B2
(45) Date of Patent: Oct. 9, 2007

(54) FLAT-TYPE FLUORESCENT LAMP DEVICE AND METHOD FOR FABRICATING THE SAME

(75) Inventors: Jae Bum Kim, Kyongsangbuk-do (KR); Won Jong Lee, Taejeon-kwangyokshi (KR); Sa Kyun Rha, Taejeon-kwangyokshi (KR)

(73) Assignee: LG.Philips LCD Co., Ltd., Seoul (KR)

( * ) Notice: Subject to any disclaimer, the term of this patent is extended or adjusted under 35 U.S.C. 154(b) by 104 days.

(21) Appl. No.: 10/747,270

(22) Filed: Dec. 30, 2003

(65) Prior Publication Data

US 2004/0150318 A1 Aug. 5, 2004

(30) Foreign Application Priority Data

Dec. 31, 2002 (KR) ..... 10-2002-0087874

(51) Int. Cl.
*H01J 1/62* (2006.01)

(52) U.S. Cl. ..... 313/493; 313/485; 313/581

(58) Field of Classification Search ..... 313/485, 313/495, 581, 634, 694, 234, 607, 609, 601, 313/486, 491, 493, 594
See application file for complete search history.

(56) References Cited

U.S. PATENT DOCUMENTS 5,329,203 A * 7/1994 Jeong ..... 313/491
5,479,069 A * 12/1995 Winsor ..... 313/496
6,114,809 A * 9/2000 Winsor ..... 315/50
6,747,404 B2 * 6/2004 Rha ..... 313/491
6,967,433 B2 * 11/2005 Hsu ..... 313/491

FOREIGN PATENT DOCUMENTS

JP 06-231731 8/1994
KR 1020020051366 A 6/2002

* cited by examiner

*Primary Examiner*—Karabi Guharay
*Assistant Examiner*—Anthony Canning
(74) *Attorney, Agent, or Firm*—Morgan, Lewis & Bockius LLP

(57) ABSTRACT

A flat-type fluorescent lamp device includes a first substrate, a plurality of first and second electrodes arranged on the first substrate at fixed intervals, a first fluorescent layer on an entire surface of the first substrate including the first and second electrodes, a second substrate having a plurality of projection portions for maintaining a uniform gap between the first and second substrates, and a second fluorescent layer on the second substrate except at regions, of the projection portions that contact the first substrate.

10 Claims, 7 Drawing Sheets

FLAT-TYPE FLUORESCENT LAMP DEVICE AND METHOD FOR FABRICATING THE SAME

The present invention claims the benefit of Korean Patent Application No. P2002-87874 filed in Korea on Dec. 31, 2002, which is hereby incorporated by reference.

BACKGROUND OF THE INVENTION

1. Field of the Invention

The present invention relates to a fluorescent lamp device, and more particularly, to a flat-type fluorescent lamp device and a method of fabricating a flat-type fluorescent lamp device.

2. Background of the Related Art

Currently, cathode ray tubes (CRTs) are commonly used in televisions, as monitors in scientific instruments, and information terminals. However, the CRTs have size and weight limitations that are in direct opposition to the trend of electronic products becoming smaller and lighter. Different types of flat display devices that are expected to replace the CRTs include liquid crystal display (LCD) devices that make use of electro-optical effects, plasma display panel (PDP) device that make use of gas-discharge, and electroluminescent display (ELD) device that make use of electroluminescent materials.

Among these flat display devices, the LCD devices have been commonly selected to replace the CRTs because of their small size, light weight, and low power consumption. Since most of the LCD devices are light receptive devices, wherein a quantity of light receivable from an exterior source is controlled to display image data, i.e., pictures, a separate light source for illuminating an LCD panel is necessary. Generally, a backlight unit is used as the light source of the LCD device and includes cylindrical fluorescent lamps. The backlight unit may be divided into different functional categories including bottom-type and edge-type backlight units.

The bottom-type backlight unit includes a plurality of lamps arranged along a first direction beneath a spreading plate for directing light toward a front surface of the LCD panel. The bottom-type backlight unit has a high light utilization efficiency as compared to the edge-type backlight unit, and is commonly used in large sized LCD panels requiring high luminance. However, incorporation of the bottom-type backlight in a thin LCD panel is limited because a gap is required between the lamps and the LCD panel in order to prevent the lamps from being visible on the LCD panel.

The edge-type backlight unit includes a fluorescent lamp at a side of a light plate for spreading the light to an entire surface of the LCD panel through the light plate. The edge-type backlight unit is commonly used in comparatively small sized LCD devices, such as monitors for laptop and desktop computers. However, incorporation of the edge-type backlight unit results in low luminance since the fluorescent lamp is provided at the side of the light plate. Accordingly, the edge-type backlight unit requires high optical design and processing technologies of the light plate for obtaining a uniform distribution of light intensity across an entire surface of the LCD panel.

FIG. 1 is a cross sectional view of an edge-type backlight unit according to the related art. In FIG. 1, a backlight unit is mounted on an under side of an LCD panel that displays image data and includes a lower cover 3 for protecting a base 1, a lamp assembly 10 for holding a lamp to be used as a light source, a light plate 5 for uniform supply of a light from the source to the LCD panel, an upper spreading plate 9 and a lower spreading plate 6 over the light plate 5 for spreading the light from the light plate 5, and an upper prism 8 and a lower prism 7 between the upper spreading plate 9 and the lower spreading plate 6 for converging and directing the light toward the LCD panel.

FIG. 2 is a perspective view of an edge-type backlight unit according to the related art. In FIG. 2, an edge-type backlight unit includes a lamp having a high voltage side lamp wire 13*a* and a low voltage side lamp wire 13*b* connected to a connector 16 in a high voltage side lamp holder 12*a* and a low voltage side lamp holder 12*b*, respectively. In addition, the lamp wires 13*a* and 13*b* are soldered to a high voltage side and a lower voltage side of the lamp, respectively, and lamp holders 12*a* and 12*b* are attached to cover the soldered part of the lamp. The lamp is placed in a lamp housing 15.

Next, the lamp assembly is mounted onto a base 1, and a lower cover 3 is attached to a part of the base 1 around a light reception part of a light plate 5. This protects the lamp assembly from external impact. After a reflective plate 4 is placed on an inside bottom of the base 1, the light plate 5 is inserted in an inside of an inner cap part of the lamp housing 15 without deforming the inside cap of the lamp housing 15. A lower spreading plate 6, a lower prism 7, an upper prism 8, and an upper spreading plate 9 are sequentially placed on the light plate 5.

When power is provided to the backlight unit through the connector 16 connected to a power source, light is emitted from the lamp as a glow discharge. Accordingly, the emitted light is incident on a light reception surface of the light plate 5, and is reflected and scattered by dots printed on a bottom of the light plate 5. The light is scattered along an oblique direction as it passes through the spreading plate 6, which is arranged along a vertical direction as the light passes through the upper and lower prisms 8 and 7. The light is scattered again along an oblique angle as the it passes through the spreading plate 9. Eventually, a portion of the light passed through the spreading plate 6 illuminates the LCD panel from a back surface. Thus, when the reflective plate 4 reflects the light, the light escapes to a back surface without being reflected and scattered by the printed dots on the light plate 5, and is transmitted upward again.

However, the backlight unit has the following disadvantages. First, since the light progresses along a lateral direction from the fluorescent lamp, the backlight unit cannot provide adequate amounts of light. Accordingly, uniform luminance cannot be provided along an entire surface of the LCD panel. Second, it is very difficult to control a surface state of the light plate and a direction of the light progression by using the light plate having the fixed pattern of printed dots. Third, the fabrication process is complicated, thereby resulting in poor device yield. For example, many defects may be generated during the fabrication process, including deformed light plates or light plates having inaccurate dimensions. Specifically, since there are different thermal expansion coefficients between the different sheets and structures, wrinkles are generated. In addition, large dimensional variations of the light plate are caused by high absorption of moisture when the LCD panel and backlight unit are exposed to high humidity. Fourth, measures to prevent contamination by foreign matter and to prevent scratches on the light plate and sheets increase production costs.

FIG. 3 is a cross sectional view of a flat-type fluorescent lamp device according to the related art, and FIG. 4 is a cross sectional view and a plan view of dark spots on the flat-type fluorescent lamp device in FIG. 3 according to the related art. In FIGS. 3 and 4, a flat-type fluorescent lamp device includes a plurality of first and second electrodes 31 and 32 arranged on a first substrate 30 at fixed intervals, a barrier layer 33 covering an entire surface of each of the first and second electrodes 31 and 32, a first fluorescent layer 34 on an entire surface of the first substrate 30 including the first and second electrodes 31 and 32 and the barrier layer 33, a second fluorescent layer 41 on a second substrate 40, and supports 42 formed between the first substrate 30 and the second substrate 40.

The first and second substrates 30 and 40 may be formed of glass or heat resistive flat material. The barrier layer 33 is formed of a material that can function as a reflective layer for directing UV light along an upward direction. The support 42 is arranged between the first and second substrates 30 and 40, and supports the first and second substrates 30 and 40, wherein sides of the support 42 are concave for providing improved discharge efficiency. In addition, side supports 43 provide support for the first substrate 30 and the second substrate 40, and confine an inert gas, such as Xe, between the first and second substrates 30 and 40.

In FIG. 3, upon application of a voltage to the first and second electrodes 31 and 32, electrons emitted from the first electrode 31 collide with atoms of the inert gas to form a plasma that emits UV light. Then, the UV light collides with the second fluorescent layer 41 on the second substrate 40 to cause the second fluorescent layer 41 to emit white light. Accordingly, the white light passes through the second substrate 40 to emit a light from an entire upper surface of the second substrate 40. However, the UV light cannot transmit through the supports 42, and this dark spots are formed in areas of the fluorescent layer 41 where no white light is transmitted. Accordingly, since the dark spots deteriorate a uniform intensity of the white light, an additional spreading film must be incorporated. The spreading film decreases productivity, increases weight, and decreases an overall luminance of the flat-type fluorescent lamp device. Moreover, the process required for attaching the supports 42 between the first and the second substrates 30 and 40 at required positions further decreases productivity.

SUMMARY OF THE INVENTION

Accordingly, the present invention is directed a flat-type fluorescent lamp device and a method of fabricating a flat-type fluorescent lamp device that substantially obviates one or more of the problems due to limitations and disadvantages of the related art.

An object of the present invention is to provide a flat-type fluorescent lamp device and a method of fabricating a flat-type fluorescent lamp device that may function as a backlight unit for large sized LCD panels.

Another object of the present invention is to provide a flat-type fluorescent lamp device and a method of fabricating a flat-type fluorescent lamp device having a simplified fabrication process for improving productivity.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a flat-type fluorescent lamp device includes a first substrate, a plurality of first and second electrodes arranged on the first substrate at fixed intervals, a first fluorescent layer on an entire surface of the first substrate including the first and second electrodes, a second substrate having a plurality of projection portions for maintaining a uniform gap between the first and second substrates, and a second fluorescent layer on the second substrate except at regions of the projection portions that contact the first substrate.

In another aspect, a flat-type fluorescent lamp device includes first and second substrates, a plurality of first and second electrodes arranged on the first substrate at fixed intervals, a barrier layer covering surfaces of each of the first and second electrodes, a first fluorescent layer on an entire surface of the first substrate and the barrier layer, a plurality of supports each attached to a region of the second substrate for maintaining a uniform gap between the first and second substrates, and a second fluorescent layer on the second substrate except at regions where the supports are formed.

In another aspect, a method of fabricating a flat-type fluorescent lamp device includes forming a plurality of first and second electrodes at fixed intervals on a first substrate, forming a barrier layer on surfaces of each of the first and second electrodes, forming a first fluorescent layer on surfaces of the first substrate and the barrier layer, forming a second substrate having a plurality of projection portions, forming a second fluorescent layer on the second substrate excluding top regions of the projection portions, and bonding the first substrate and the second substrate together.

In another aspect, a method of fabricating a flat-type fluorescent lamp device includes forming a plurality of first and second electrodes on a first substrate, forming a barrier layer on surfaces of the first and second electrodes, forming a first fluorescent layer on the barrier layer, forming a first fluorescent layer on the first substrate including the barrier layer, forming a plurality of supports on a second substrate, each support having end portion, forming a second fluorescent layer on sidewall surfaces of the supports and the second substrate, and attaching the first and second substrates together,wherein the end portions of the supports contact first regions of the first fluorescent layer between adjacent ones of the first and second electrodes.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
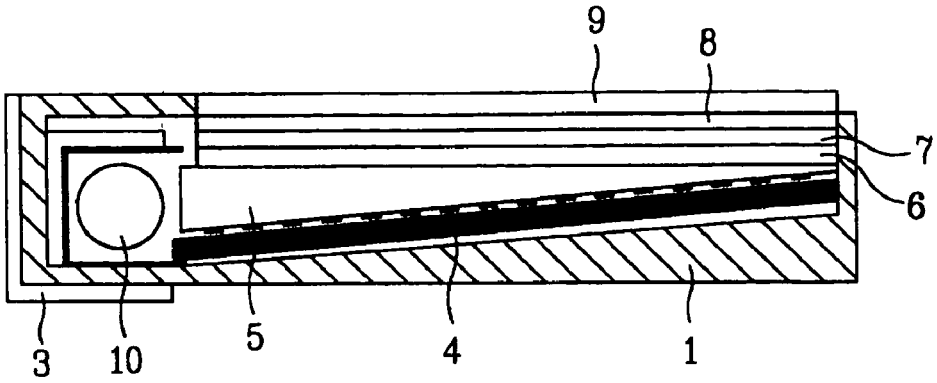
FIG.1 Related Art
FIG. 1 is a cross sectional view of an edge-type backlight unit according to the related art.
Figure 2:
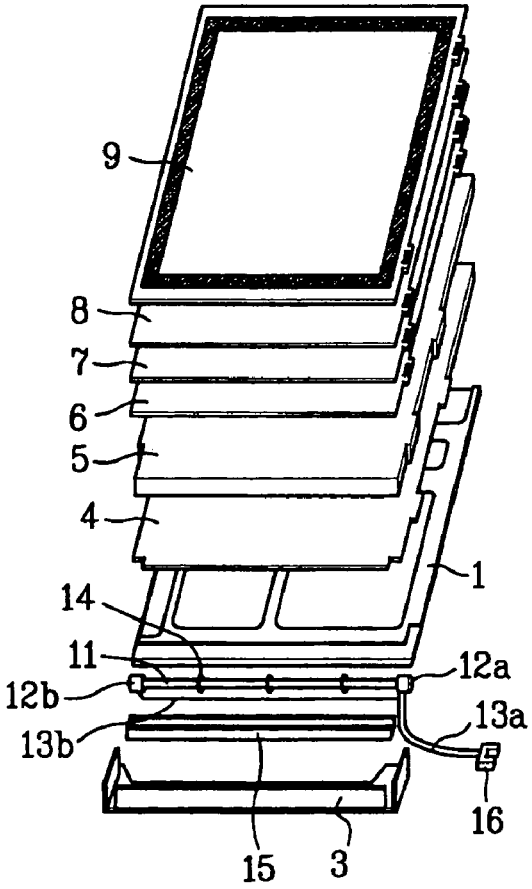
FIG.2 Related Art
FIG. 2 is a perspective view of an edge-type backlight unit according to the related art.
Figure 3:
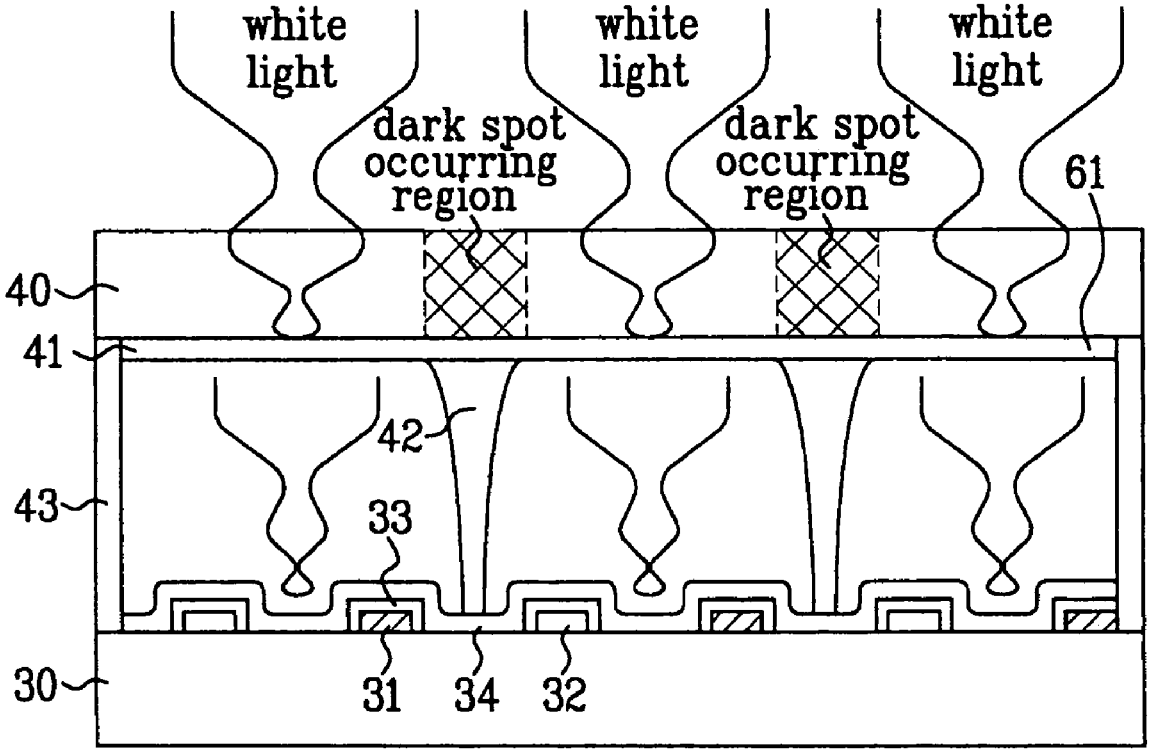
FIG.3 Related Art
FIG. 3 is a cross sectional view of a flat-type fluorescent lamp device according to the related art.
Figure 4:
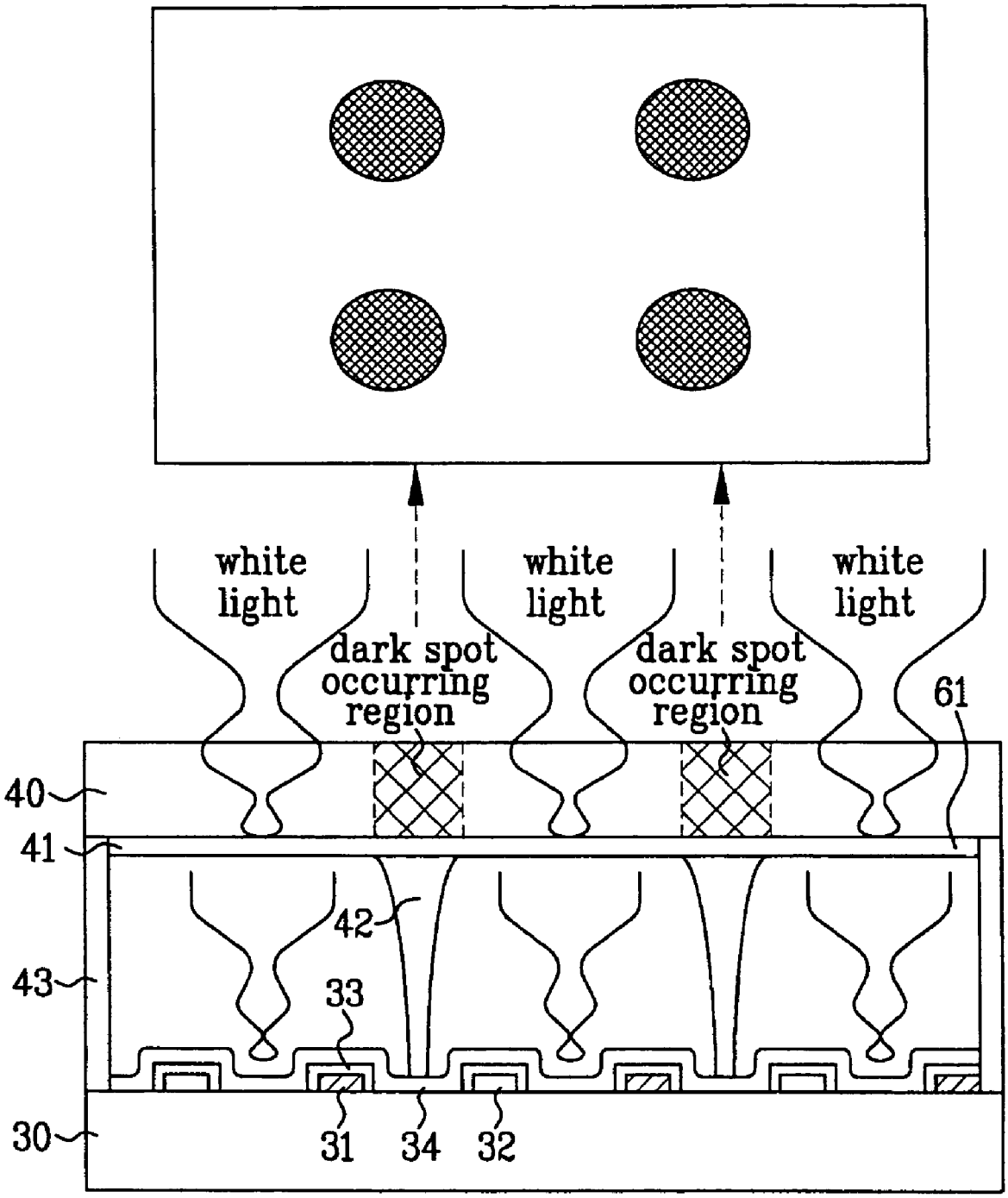
FIG. 4 Related Art
FIG. 4 is a cross sectional view and a plan view of dark spots on the flat-type fluorescent lamp device in FIG. 3 according to the related art.
Figure 5:
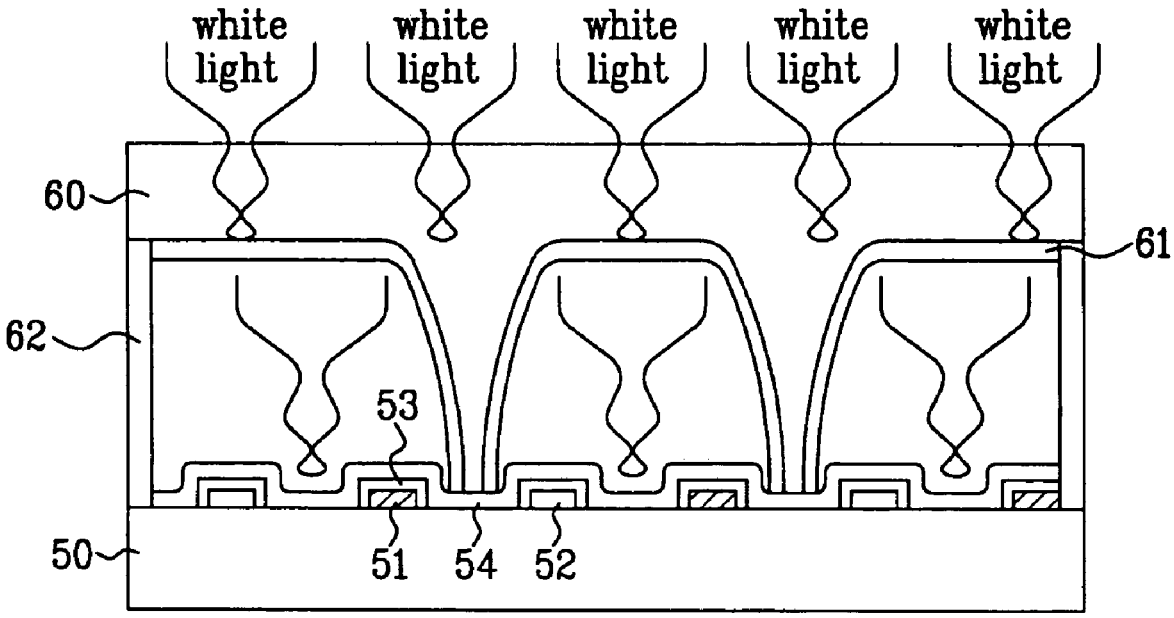
FIG. 5 is a cross sectional view of an exemplary flat-type fluorescent lamp device according to the present invention.

FIG. 5 is a cross sectional view of an exemplary flat-type fluorescent lamp device according to the present invention. In FIG. 5, a flat-type fluorescent lamp device may include a plurality of first and second electrodes 51 and 52 arranged on a first substrate 50 at fixed intervals, a barrier layer 53 covering on an entire surface of each of the first and second electrodes 51 and 52, a first fluorescent layer 54 on an entire surface of the first substrate 50 including the first and second electrodes 51 and 52 and the barrier layer 53, a second substrate 60 having projections for maintaining a gap with the first substrate 50, and a second fluorescent layer 61 on the second substrate 60 except at top surfaces of the projections that contact the first substrate 50.

Although not shown, the first electrodes 51 may be arranged on the first substrate 50 along a first direction at fixed intervals, and may each have first ends connected to each other with sharp projections formed at one or both sides thereof.

The second electrodes 52 may be arranged along the first direction spaced at fixed distances apart from the first electrodes 51, and may each have ends connected to each other. In addition, two of the second electrodes 52 may be arranged in parallel with, and between the first electrodes 51. The first electrode 51 may be used as a cathode, and the second electrode 52 may be used as an anode.

The first and second substrates 50 and 60 may be formed of glass material or heat resistive material. The barrier layer 53 may function as a dielectric layer and may contain material(s) that can prevent electrons emitted during discharge between the first electrode 51 and the second electrode 52 from damaging the first and second electrodes 51 and 52. In addition, the material(s) may function as a reflective layer for directing UV light along an upward direction. For example, the barrier layer 53 may be formed of at least one of AlN, $BaTiO_3$, SiNx, and SiOx, and the first and second electrodes 51 and 52 may be formed of a low resistivity metal, such as silver Ag, chrome Cr, platinum Pt, and copper Cu.

The projection portions of the second substrate 60 may be formed as a unit with the second substrate 60 in order to maintain a uniform gap between the first and second substrates 50 and 60. The projection portions of the second substrate 60 may have concave sides, wherein a first width of the projection portions that contact the second substrate 60 may be greater than a second width of the projection portions that contact the first substrate 50, thereby increasing discharge efficiency.

In FIG. 5, side supports 62 may be provided for supporting sides of the first and second substrates 50 and 60, and may be formed of material(s) of the first and second substrates 50 and 60. In addition, the side supports 62 may also be formed as an integral unit with the second substrate 60. Accordingly, the side supports 62 may function to contain a composite gas between the first and second substrates 50 and 60. Thus, by forming the projection portions of the second substrate 60 to function as supports for maintaining the uniform gap between the first and second substrates 50 and 60, occurrence of dark spots may be prevented. Since the second fluorescent layer 61 may not be formed at portions where the projection portions contact portions of the first substrate 50, transmission of the UV light will be generated.

Figure 6A:
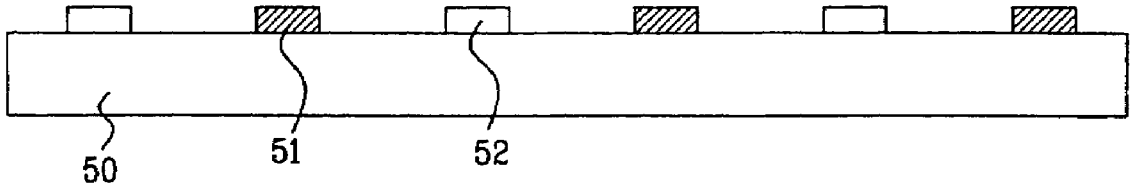
FIGS. 6A to 6E are cross sectional views of an exemplary method of fabricating a flat-type fluorescent lamp device according to the present invention.

FIGS. 6A to 6E are cross sectional views of an exemplary method of fabricating a flat-type fluorescent lamp device according to the present invention. In FIG. 6A, first and second electrodes 51 and 52 may be formed at fixed intervals on a first substrate 50 by screen printing or photolithography that may include exposure and development processes. The first substrate 50 may be formed of a metal or an oxide, such as glass or heat resistive material, and the first and second electrodes 51 and 52 may be formed of silver Ag, chrome Cr, platinum Pt, or copper Cu. Accordingly, the first electrode 51 functions as a cathode and the second electrode 52 may function as an anode.

Figure 6B:
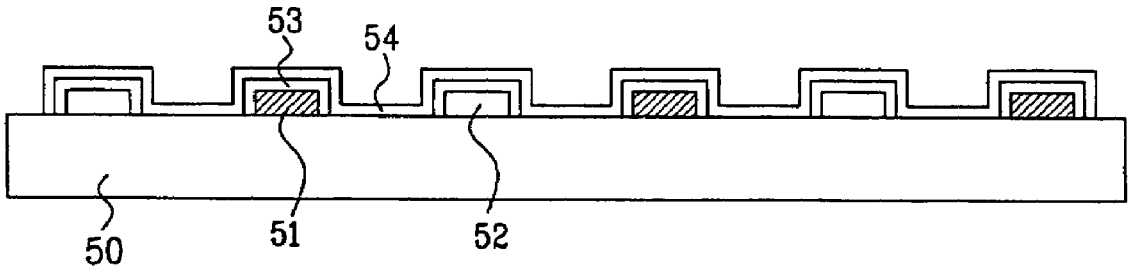

In FIG. 6B, a barrier layer 53 may be formed to cover surfaces of the first and second electrodes 51 and 52. Then, a first fluorescent layer 54 may be formed to cover the barrier layer 53 and surface portions of the first substrate 50 between the first and second electrodes 51 and 52. The barrier layer 53 may include material(s) that functions both as a barrier for preventing damage by electrons emitted during discharge between the first and second electrodes 51 and 52 and as a reflective layer for preventing the UV light from being directed along a downward direction. The barrier layer 53 may include at least one of AlN, $BaTiO_3$, SiNx, and SiOx.

Figure 6C:
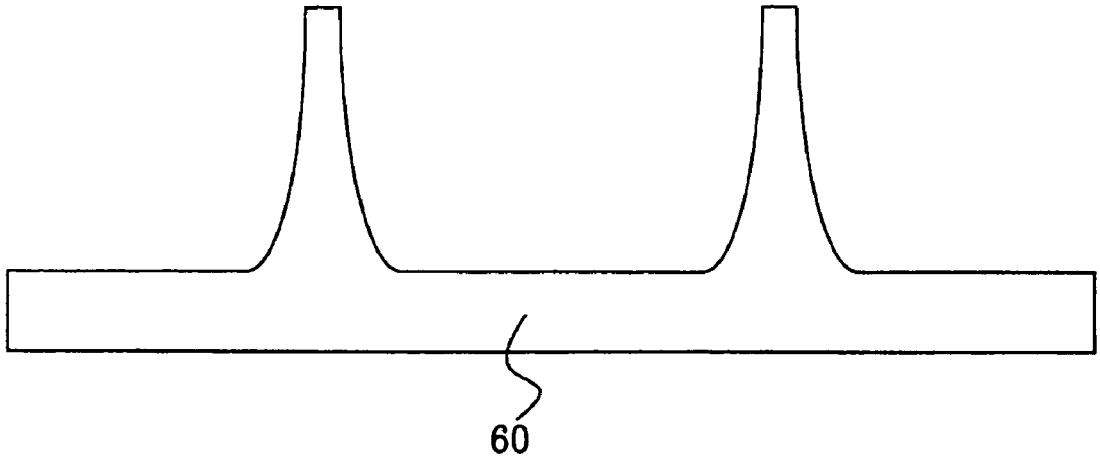

In FIG. 6C, a second substrate 60 may include a plurality of projection portions. The projection portions of the second substrate 60 may function as supports for maintaining a uniform gap between the first substrate 50 and the second substrate 60. Each of the projection portions may be formed having concave side surfaces, wherein a first area of the projection portions that contact the second substrate 60 may be larger than a second area of the projection portions that contact portions of the first substrate 50. Moreover, a first width of the projection portions that contact the second substrate 60 may be larger than a second width of the projection portions that contact portions of the first substrate 50. The second substrate 60, and the projection portions may include glass or heat resistive materials.

Figure 6D:
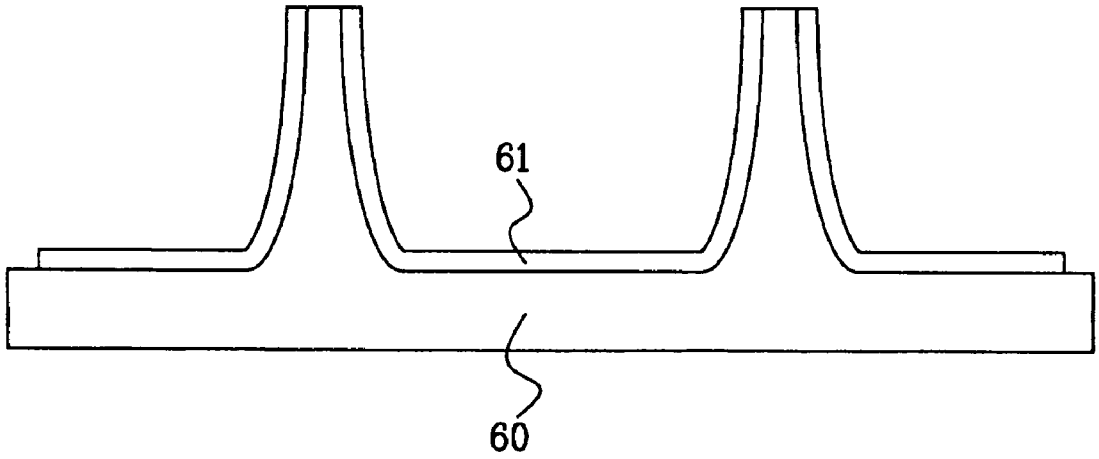

In FIG. 6D, a second fluorescent layer 61 may be formed on the second substrate 60 except along top regions of the projection portions that will contact the portions of the first substrate 50.

Figure 6E:
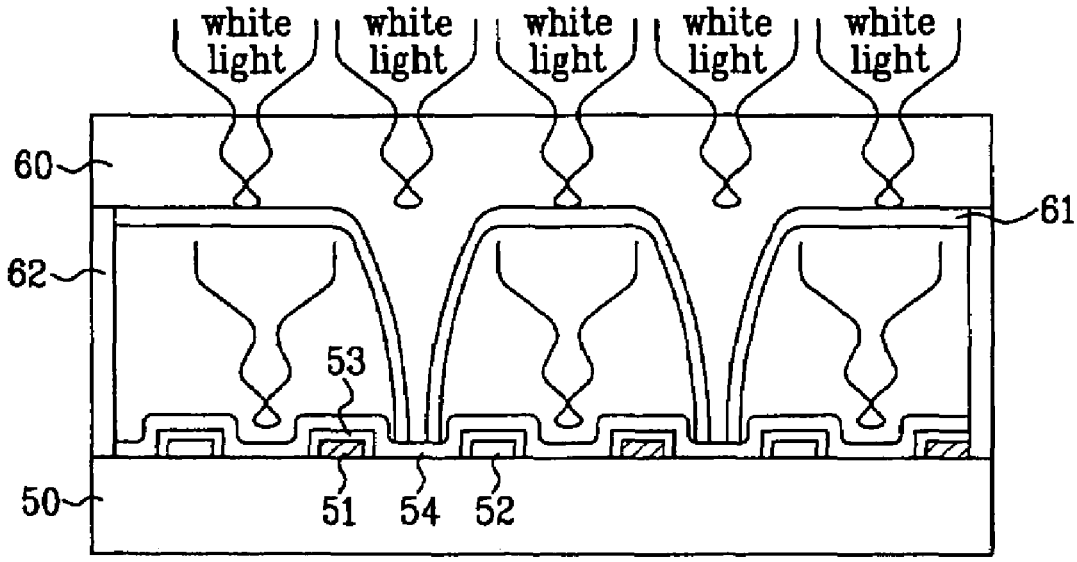

In FIG. 6E, after bonding the first substrate 50 and the second substrate 60 with side supports 62, a composite fluorescent gas that includes Xe may be injected through a gas injection hole (not shown), and sealed. In addition, the side supports may be formed as an integral unit with the second substrate 60 along with the projection portions.

Next, although not shown, a flexible printed circuit (FPC) may be soldered onto the first and second substrates 50 and 60 and to a connector assembly wire. Upon connection of the connector assembly to a power supply, UV light may be emitted from glow discharge as a result of an induced electric field between the first and second electrodes 51 and 52, or from a plasma formed as electrons emitted from the first electrode 51 collide with the composite fluorescent gas. The UV light emitted collides with the second fluorescent layer 61 on the second substrate 60, thereby emitting white light. In turn, the white light may be reflected by the first fluorescent layer 54 formed on the barrier film and portions of the first substrate 50, and may be directed such that the white light is transmitted from an entire upper surface of the second substrate 60. Accordingly, formation of the projection portions as an integral unit with the second substrate 60 may prevent formation of dark spots. In addition, since separate formation processes of the supports 62 may not be required, an overall fabrication process of the flat-type fluorescent lamp device may be simplified, thereby improving productivity. Moreover, since no additional spreading film may be required for moderating the dark spots, an overall weight of the flat-type fluorescent lamp device may be reduced.

Figure 7:
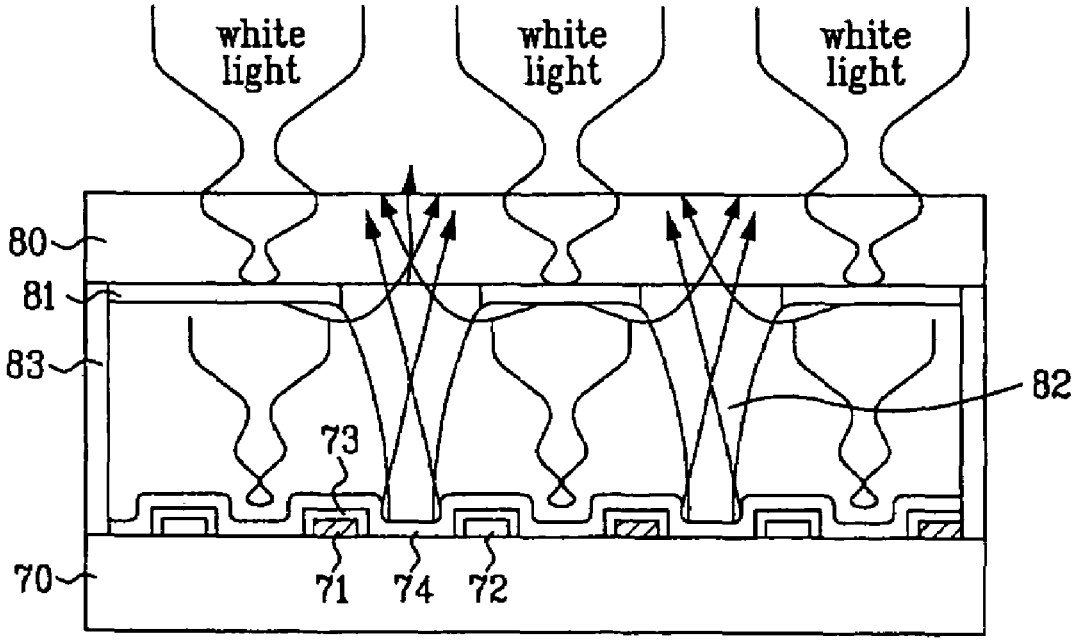
FIG. 7 is a cross sectional view of another exemplary flat-type fluorescent lamp device according to the present invention.

FIG. 7 is a cross sectional view of another exemplary flat-type fluorescent lamp device according to the present invention. In FIG. 7, a flat-type fluorescent lamp device may include a plurality of first and second electrodes 71 and 72 arranged on a first substrate 70 at fixed intervals, a barrier layer 73 covering on an entire surface of each of the first and second electrodes 71 and 72, a first fluorescent layer 74 on an entire surface of the first substrate 70 including the barrier layer 73, supports 82 attached to a region of the second substrate 80 for maintaining a uniform gap between the first and second substrates 70 and 80, and a second fluorescent layer 81 on the second substrate 80 except at regions where the supports 82 may be formed. Although not shown, the first electrodes 71 may be arranged on the first substrate 70 along a first direction at fixed intervals, and may each have ends connected to each other and sharp projections may be included at one or both sides thereof. In addition, the supports 82 may include concave sides.

The first electrode 71 may function as a cathode, and the second electrode 72 may function as an anode. Alternatively, the first electrode 71 may function as an anode, and the second electrode 72 may function as a cathode.

The first and second substrates 70 and 80 may be formed of glass or heat resistive materials. The barrier layer 73 on the surfaces of the first and second electrodes 71 and 72 may include material(s) that may prevent damage caused by the electrons emitted in discharge between the first electrode 71 and the second electrode 72. In addition, the material(s) of the barrier layer 73 may function as a reflective layer for directing UV light emitted in the discharge along an upward direction. For example, the barrier layer 73 may include at least one of AlN, $BaTiO_3$, SiNx, and SiOx, and the first and second electrodes 71 and 72 may include a low resistivity metal, such as silver Ag, chrome Cr, platinum Pt, and copper Cu.

Side supports 83 may be provided for supporting sides of the first and second substrates 70 and 80, and may include material(s) that are similar to material(s) of the first and second substrates 70 and 80. In addition, the side supports may be provided to confine, a composite gas, such as Xe, between the first and second substrates 70 and 80. Accordingly, when a connector assembly is connected to the flat-type fluorescent lamp device to a power supply, UV light may be emitted from glow discharge induced by an electric field between the first and second electrodes 71 and 72, or from a plasma formed as electrons emitted from the first electrode 71 collide with atoms of the composite gas. The emitted UV light collides with the second fluorescent layer 81 on the second substrate 80, to emit white light that may be reflected by the barrier film 73 on the first substrate 70 and the first fluorescent layer 74. Accordingly, the white light may be directed such that the white light is emitted from an entire upper surface of the second substrate 80.

By not forming the second fluorescent layer 81 on portions of the supports 82, an occurrence of dark spots may be prevented. For example, the UV light cannot pass through the supports 82, and the second fluorescent layer 81 emits visible light when the UV light collides with the second fluorescent layer 81. Since a portion of the visible light progresses between the first and second substrates 70 and 80, most of the emitted visible light progresses to an upper part of the second substrate 80 to the LCD panel.

When the visible light between the first and second substrates 70 and 80 progresses through the supports 82, if the second fluorescent layer 81 is formed on a part of the second substrate 80 that contacts the support 82, a dark spot will be generated. However, if no second fluorescent layer 81 is formed on portions of the second substrate 80 where the supports 82 are formed, the visible light will pass through the supports 82 and the dark spots will not be generated.

The exemplary flat-type fluorescent lamp devices in accordance with the present invention may be used not only as a lamp device but also as a separate light source at a rear or front of a display device, such as a monitor, a notebook computer, and a television.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A flat-type fluorescent lamp device, comprising:

a first substrate having first and second surfaces;

a plurality of first and second electrodes arranged on the first surface of the first substrate at fixed intervals;

a first fluorescent layer on an entire of the first surface of the first substrate including the first and second electrodes;

a second substrate having a plurality of projection portions for maintaining a uniform gap between the first and second substrates, wherein the plurality of projection portions have first areas contacted with the first fluorescent layer; and a second fluorescent layer on the second substrate except at second areas of the projection portions that contact the second substrate.

2. The device according to claim 1, wherein the projection portions of the second substrate have a first width that is larger than a second width of the projection portions that contact the first substrate.

3. The device according to claim 1, wherein the projection portions of the second substrate have concave sides.

4. The device according to claim 1, further comprising side supports for supporting side parts of the first and second substrates.

5. The device according to claim 4, wherein the side supports are an integral portion of the second substrate.

6. The device according to claim 1, further comprising a barrier layer between the first fluorescent layer and each of the first and second electrodes and covering top and side surfaces of the first and second electrodes and portions of the first substrate.

7. The device according to claim 6, wherein the barrier layer includes at least one of AlN, $BaTiO_3$, SiNx, and SiOx.

8. The device according to claim 1, wherein the first and second substrates both include one of glass and a heat resistive material.

9. The device according to claim 1, wherein the first substrate includes one of a metal material and an insulating material.

10. A flat-type fluorescent lamp device, comprising:

first and second substrates;

a plurality of first and second electrodes arranged on the first substrate at fixed intervals;

a barrier layer covering surfaces of each of the first and second electrodes;

a first fluorescent layer on an entire surface of the first substrate and the baffler layer;

a plurality of supports each attached to a region of the second substrate for maintaining a uniform gap between the first and second substrates; and a second fluorescent layer on the second substrate except at regions where the supports are formed in contact with the second substrate.

* * * * *